United States Patent [19]

Abbott

[11] 4,201,578

[45] May 6, 1980

[54] BLOCKED COMPETING DEVELOPERS FOR COLOR TRANSFER

[75] Inventor: Thomas I. Abbott, Rochester, N.Y.

[73] Assignee: Eastman Kodak Company, Rochester, N.Y.

[21] Appl. No.: 955,831

[22] Filed: Oct. 30, 1978

Related U.S. Application Data

[63] Continuation-in-part of Ser. No. 848,061, Nov. 3, 1977, abandoned.

[51] Int. Cl.[2] ..... G03C 5/54; G03C 1/40; G03C 7/00; G03C 17/06

[52] U.S. Cl. ..... 430/222; 428/520; 428/522; 430/224; 430/958; 430/226; 430/552; 430/566

[58] Field of Search ..... 96/3, 29 D, 77, 119 R; 428/522, 520

[56] References Cited

U.S. PATENT DOCUMENTS

| | | | |
|---|---|---|---|
| 3,246,988 | 4/1966 | Porter et al. | 96/66 R |
| 3,462,266 | 8/1969 | Stewart | 96/29 D |
| 3,576,625 | 4/1971 | Land | 96/77 |
| 3,816,126 | 6/1974 | Charkoudian | 96/77 |

OTHER PUBLICATIONS

"Photographic Processes and Products," *Research Disclosure* No. 15162 Nov. 1976 pp. 76–89.

*Primary Examiner*—Richard L. Schilling
*Attorney, Agent, or Firm*—Harold E. Cole

[57] ABSTRACT

Hydroquinone esters are incorporated in or behind a timing layer with a high activation energy to release a competing developer upon contact with a processing composition.

25 Claims, No Drawings

BLOCKED COMPETING DEVELOPERS FOR COLOR TRANSFER

This application is a continuation-in-part of my copending U.S. application Ser. No. 848,061, filed on Nov. 3, 1977, now abandoned.

This invention relates to photography, and more particularly to photographic assemblages for color diffusion transfer photography wherein a hydroquinone ester is employed in or behind a timing layer having a high activation energy to release a competing developer upon contact with a processing composition.

Various formats for color integral transfer elements are described in the prior art, such as U.S. Pat. Nos. 3,415,644; 3,415,645; 3,415,646; 3,647,437; 3,635,707; 3,756,815 and Canadian Pat. Nos. 928,559 and 674,082. In these formats, the image-receiving layer containing the photographic image for viewing can remain permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel-apart" formats for color diffusion transfer assemblages are described, for example, in U.S. Pat. Nos. 2,983,606; 3,362,819; and 3,362,821. In these formats, the image-receiving element is separated from the photosensitive element after development and transfer of the dyes to the image-receiving layer.

U.S. Pat. No. 3,462,266 relates to oxazines and bisoxazines which are cleaved to hydroquinones under alkaline conditions. The compounds are described as being auxiliary developer precursors in dye developer image transfer systems and may be present in various locations, such as an overcoat layer, a spacer layer, a mordant layer or an acidic layer.

U.S. Pat. No. 3,816,126 describes the use of certain alkyl and haloalkyl esters as auxiliary developer precursors in a diffusion transfer system. These auxiliary developer precursors are disclosed as being located in the processing composition or in one or more layers of the photosensitive element. There is no disclosure in this patent, however, that these compounds may be used as competing developers located in or behind a timing layer having a high activation energy.

Competing developing agents have been used in various photographic assemblages heretofore. For example, *Research Disclosure* 15162, November 1976, on page 79, discloses that combinations of certain developing agents with alkali-soluble competing developers such as hydroquinone, methylhydroquinone and t-butylhydroquinone are especially useful in achieving the desired sensitometric curve shape of the dye image in diffusion transfer assemblages, such as those employing dye releasers described therein. For example, in diffusion transfer systems, optimum development temperatures are not always obtainable. At high temperatures, such as 32° to 35° C., there is faster development with more dye being released, causing a significant loss in speed, an increase in $D_{max}$ and an increase in $D_{min}$. The presence of a competing developing agent in the processing composition in the right concentration will help to alleviate the problem somewhat, since it will develop silver but will not cause any dye to be released. The $D_{min}$ can be lowered in this manner, but the speed loss is still there. The increase in $D_{max}$ is also still there, but is not as noticeable to the eye.

Another problem with employing a competing developer in the processing composition concerns the variability of the developer layer thickness, or DLT, in a given film unit. In cameras where the operator hands cranks the film units out of the camera, the speed at which he operates the crank will affect the DLT—e.g., a fast cranking motion will provide a relatively low DLT. In cameras having a motor drive, the DLT varies with the viscosity of the processing composition, the temperature of processing, etc. This variable DLT, in turn, magnifies the variability of a competing developer employed in the processing composition, since it is employed at a relatively low concentration.

In accordance with my invention, I have found that competing developing agents may be utilized in such a way as to significantly reduce the speed loss attendant with high temperature development described above, as well as eliminating the variability of their concentration with variability in DLT. I have found that employing certain hydroquinone esters in or behind a timing layer with a high activation energy will provide these advantages. Employing such compounds in or behind a timing layer provides a time delay before the material becomes operative. During processing, the processing composition penetrates through all or a part of the timing layer until it contacts the hydroquinone ester. The ester groups when hydrolyze and the resulting hydroquinone is free to diffuse to the photosensitive layers to take part in development. By employing the hydroquinone in its "blocked" or water-insoluble ester form, it can be easily and advantageously incorporated into an organic solvent-coated polymeric layer underlying the timing layer, in a preferred embodiment, and it remains stable upon incubation.

The timing layer employed in this invention has a high activation energy of penetration by aqueous alkali. It rapidly "breaks down" or "opens up" at a temperature above about 30° C. Below that temperature, its penetration by the processing composition is relatively slow. However, this enables the hydroquinone esters to be incorporated in relatively large amounts. During processing at 32° C. when dye release would ordinarily be excessive, this timing layer breaks down rapidly and allows a large amount of competing developer to diffuse to the developing silver. The result is a large amount of silver development, but the dye release is approximately the same as it would be at lower temperatures. The speed loss which would otherwise be obtained is, therefore, significantly reduced. Incorporation of larger amounts of competing developer in the processing composition would not provide the same effect, since it would significantly lower dye release at all temperatures. My invention thus provides a means for significantly controlling the effects of high temperature overdevelopment which would ordinarily result in dark images of high dye density.

A photographic assemblage according to my invention comprises:

(a) a support having thereon at least one photosensitive silver halide emulsion layer having associated therewith a dye image-providing material;
(b) a dye image-receiving layer;
(c) an alkaline processing composition and means for discharging same within the assemblage;
(d) a neutralizing layer for neutralizing the alkaline processing composition; and
(e) a timing layer disposed between the neutralizing layer and the photosensitive silver halide emulsion layer so that the processing composition must first permeate the timing layer before contacting the neutralizing layer;

the neutralizing layer being located on the side of the timing layer which is farthest from the dye image-receiving layer, the assemblage containing a silver halide developing agent, and wherein the assemblage contains a hydroquinone ester either (1) in the timing layer, or (2) in a layer which is adjacent thereto and is so located with respect to the timing layer that the processing composition must first permeate the timing layer before contacting the adjacent layer, the hydroquinone ester having the following formula:

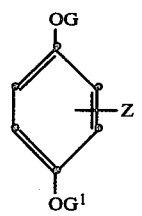

wherein:

G is hydrogen, COR or $SO_2R$;
G' is COR or $SO_2R$;
R is an alkyl (including substituted alkyl) group having from 1 to about 20 carbon atoms or an aryl (including substituted aryl) group having from 6 to about 12 carbon atoms; and
Z is hydrogen, an alkyl (including substituted alkyl) group having from 1 to about 6 carbon atoms, an alkoxy group having from 1 to about 6 carbon atoms, or an aryl (including substituted aryl) group having from about 6 to about 8 carbon atoms, and wherein the timing layer has an activation energy of penetration of the layer by an aqueous alkaline solution of greater than 18 kcal/mole.

In the above formula, Z can be hydrogen; an alkyl group of 1 to about 6 carbon atoms, such as methyl, ethyl, isopropyl, t-butyl, etc, an alkoxy group of 1 to about 6 carbon atoms, such as methoxy or ethoxy, or an aryl group having 6 to about 8 carbon atoms, such as phenyl, m-tolyl, p-methoxyphenyl, etc, as long as the compound will diffuse at a sufficient rate when the acyl or sulfonyl group or groups are hydrolyzed. In a similar manner, when each of G and G' in the formula is an acyl or sulfonyl group, any such group such as acetyl, propionyl, benzoyl, ethoxycarbonyl, ethoxalyl, methylsulfonyl, tolylsulfonyl, etc, can be employed, so long as it can be hydrolyzed to the corresponding hydroquinone.

The hydroquinone esters can be employed according to my invention at any concentration effective for the intended purpose. Good results have been obtained at a concentration of from about 0.054 g/m$^2$ to about 0.54 g/m$^2$, and especially good results have been obtained at a concentration of from about 0.10 g/m$^2$ to about 0.45 g/m$^2$.

Examples of hydroquinone esters useful in my invention include the following:

Hydroquininone diacetate (1)

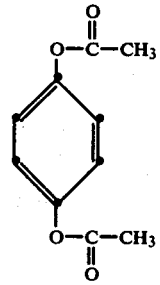

Hydroquinone monohexanoate (2)

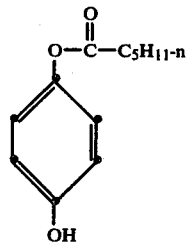

3-t-butyl-4-hydroxyphenyl acetate (3)

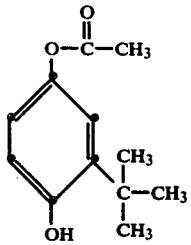

Hydroquinone monoacetate (4)

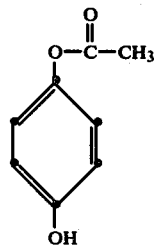

Hydroquinone monobenzoate (5)

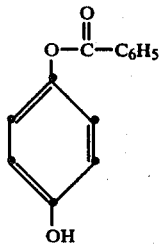

2-Methylhydroquinone monoacetate (6)

-continued

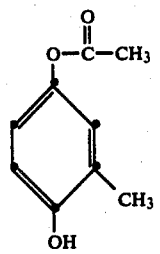

2-Methoxyhydroquinone monoacetate (7)

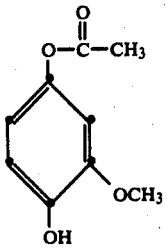

2-Methylhydroquinone monobenzoate (8)

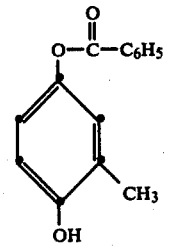

2-Methoxyhydroquinone monobenzoate (9)

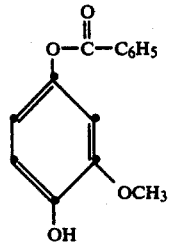

2-Ethoxyhydroquinone monoacetate (10)

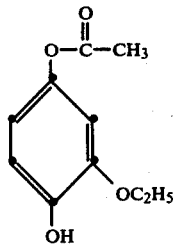

2-Ethoxyhydroquinone monobenzoate (11)

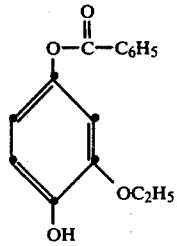

p-Methylsulfonyloxyphenol (12)

-continued

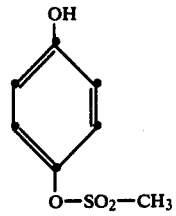

p-Tolylsulfonyloxyphenol (13)

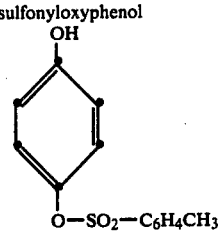

As noted above, the hydroquinone esters employed in this invention can be employed either in or behind the timing layer with respect to the side of application of the processing composition. Preferably, it is incorporated in the timing layer so that the release of the competing developer occurs after a finite time. When a longer delay is desired, the compound is merely incorporated in an adjacent layer, behind the timing layer and farther away from the developing silver halide layers. This layer can be contiguous to the timing layer or can be located in an adjacent layer several layers away from the timing layer, depending upon the results desired.

Any material can be used as the timing layer in my invention, as long as it has a high activation energy of penetration by aqueous alkali, as described above. In a preferred embodiment of my invention, the timing layer comprises a polymeric latex having an activation energy of penetration of the layer by an aqueous alkaline solution of greater than 18 kcal/mole. Such latex timing layers result from a coalescence or partial coalesence of polymeric particles from an aqueous latex. Preferred latex timing layers are described, along with their method of synthesis, in U.S. Pat. No. 4,056,394 of Hannie, issued Nov. 1, 1977, the disclosure of which is hereby incorporated by reference. These timing layers delay the neutralization of the alkaline processing composition by the acid layer so that production of a high quality dye image is more reproducible over a large temperature range.

The activation energy of penetration of polymeric layers by aqueous alkaline solutions useful in my invention can be determined by the following simple test.

A thymolphthalein dye or cresol red dye indicator is coated on a polyethylene terephthalate film support at 210 mg/m$^2$ with 6.6 g/m$^2$ gelatin in the case of thymolphthalein or 2.2 g/m$^2$ in the case of cresol red.

A processing composition comprising a pod which contains about 0.84 N potassium hydroxide and about 5 percent carboxymethyl cellulose in water, along with other conventional developer ingredients, is spread between the element containing the indicator dye and a sample of a cover sheet by passing the "sandwich" between a pair of juxtaposed pressure rollers so that the developer layer thickness is 0.1 mm.

The cover sheet comprises a polyethylene terephthalate support containing a first layer of a 30/70 (by weight) copolymer of poly(butyl acrylate-co-acrylic acid), a second layer of 50/50 (mole ratio) polymer of poly(styrene-co-maleic anhydride) at 2.2 g/m$^2$ and the outer layer being the polymer for which the activation energy is to be determined.

The time required to reduce the pH of a unit to pH 10 as measured by the color change of the thymolphthalein dye from blue to colorless or to pH 8 as measured by the change of the cresol red dye from red to yellow is measured at various temperatures within the range of 13° to 54° C. The time in seconds is plotted on a logarithmic scale against the reciprocal of the temperature expressed in ° K. The activation energy in kcal/mole is determined from the slope of the straight line portion of the curve according to the formula:

$$-E_a \text{ (activation energy)} = 0.00458 \times \frac{\log Y_2/Y_1}{1/T_2 - 1/T_1}$$

where $T_2$ is the higher temperature and $T_1$ is the lower temperature and $Y_2$ is the time at $T_2$ and $Y_1$ is the time at $T_1$. The thickness of the acid layer and the polymer layer is not critical to the proper determination of activation energy.

A discussion of activation energy calculations can be found in *Kinetics and Mechanism,* second edition, New York, John Wiley and Sons, 1961, pages 22 through 25.

Latex polymers having an activation energy to penetration by aqueous alkaline solution of greater than 18 kcal/mole include poly(methyl acrylate-co-itaconic acid-co-vinylidene chloride) and the like.

Preferred polymeric latexes having an activation energy of penetration to aqueous alkaline solution of greater than 18 kcal/mole are terpolymers of from about 5 to about 35 percent by weight of polymerized ethylenically unsaturated monomer, from about 2 to about 10 percent by weight of polymerized ethylenically unsaturated carboxylic acid and from about 55 to about 85 percent by weight of polymerized vinylidene chloride.

Any ethylenically unsaturated monomer which is different from the other monomers in the polymeric latex can be used to prepare the terpolymer including alkyl acrylates and methacrylates such as methyl acrylate, ethyl acrylate, propyl acrylate, butyl acrylate, butyl methacrylate and the like; vinyl esters, amides, nitriles, ketones, halides, ethers, olefins, diolefins and the like as exemplified by acrylonitrile, methacrylonitrile, styrene, alpha-methyl styrene, acrylamide, methacrylamide, vinyl chloride, methyl vinyl ketone, fumaric, maleic and itaconic esters, 2-chloroethylvinyl ether, dimethylaminoethyl methacrylate, 2-hydroxyethyl methacrylate, N-vinylsuccinamide, N-vinylphthalimide, N-vinylpyrrolidone, butadiene, ethylene and the like. Preferred monomers are methyl acrylate and acrylonitrile.

Examples of ethylenically unsaturated carboxylic acids which can be included in the polymer include acrylic acid, methacrylic acid, itaconic acid, fumaric acid, maleic acid, their anhydrides, and the like. The preferred carboxylic acids are acrylic acid and itaconic acid.

A preferred terpolymer useful in the invention comprises 15 weight percent methyl acrylate, 83 weight percent vinylidene chloride and 2 weight percent itaconic acid. Further examples of latex polymers useful herein can be found in U.S. Pat. Nos. 3,271,345; 2,627,088; 2,491,023; 2,779,684; 3,437,484; 2,943,937 and 3,143,421.

The latex timing layer can generally be employed over a broad range of coverages. Preferred coverage for the layer ranges from about 1.0 g/m$^2$ to 6.0 g/m$^2$ and more preferably from about 1 to 3 g/m$^2$.

In another preferred embodiment of my invention, the timing layer which has an activation energy of penetration of the layer by an aqueous alkaline solution of greater than 18 kcal/mole comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, as described above, and from about 0 to about 20 percent by weight of an ethylenically unsaturated carboxylic acid, as described above, and (2) from about 5 to about 95 percent by weight of a polymeric carboxy-ester-lactone. This preferred timing layer is the subject of an invention by my coworker, Edward P. Abel, in U.S. application Ser. No. 948,062, filed Oct. 2, 1978, entitled "Barrier Layers Between Reactants in Photographic Products Comprising a Mixture of Vinylidene Chloride Terpolymer and Polymeric Carboxy-Ester-Lactone". Such polymeric carboxy-ester-lactones may comprise, for example, the following recurring structural units:

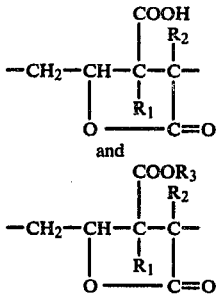

and wherein:

$R_3$ is alkyl having from 1 to about 12 carbon atoms or aralkyl wherein said alkyl comprises from about 1 to about 4 carbon atoms; and $R_1$ and $R_2$ are independently hydrogen or methyl.

In another preferred embodiment, the lactone additionally comprises the following units:

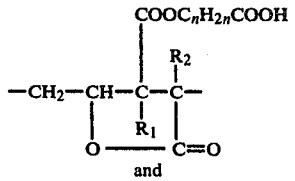

and

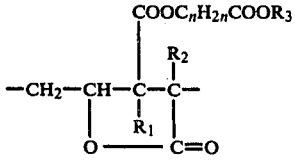

wherein n is an integer of from 1 to 5 and $R_3$, $R_1$ and $R_2$ are defined as above. For specific examples of such timing layers, polymeric carboxy-ester-lactones and their methods of preparation, reference is made to the Abel U.S. application Ser. No. 948,062, filed Oct. 2, 1978, described above, the disclosure of which is hereby incorporated by reference.

In another preferred embodiment of my invention, the hydroquinone esters are incorporated in an adjacent layer comprising a timing layer, which layer, in turn is coated with the latex timing layer having a high activation energy described above. In this "double" timing layer embodiment, the first timing layer in which the hydroquinone esters are employed comprises a polymeric latex having an activation energy of penetration to aqueous alkaline solution of less than 18 kcal/mole. The second timing layer is as described above and comprises a polymeric latex having an activation energy of penetration to aqueous alkaline solution of greater than 18 kcal/mole. This "double" timing layer system is described more fully in U.S. Pat. No. 4,061,496 of Hannie and Ducharme, issued Dec. 6, 1977, the disclosure of which is hereby incorporated by reference.

Examples of polymers for the first timing layer described above having an activation energy of penetration of aqueous alkaline composition of less than 18 kcal/mole are mixtures of cellulose acetate and a maleic anhydride copolymer with 5 to 50 percent by weight of the mixture being said copolymer such as described in U.S. Pat. No. 4,009,030 of Abel, issued Feb. 22, 1977.

The maleic anhydride copolymer in this timing layer should be employed in a concentration of about 2 to about 20 percent by weight, depending somewhat on the other comonomer. A 5 to 20 percent concentration has been found to be particularly effective. The thickness of this timing layer should be such as to provide a coverage of about 1 to about 5 g/m$^2$.

The cellulose acetate employed in that layer will usually have acetyl contents of about 37 to 40 percent by weight, the 37 percent being substantially more permeable than the 40 percent acetyl. Mixed esters can also be employed, such as cellulose acetate propionate, cellulose acetate butyrate, etc.

The maleic anhydride copolymer can be selected from a wide variety of materials, so long as it is compatible with the cellulose acetate employed to provide a clear film. Particularly good results are obtained with poly(styrene-co-maleic anhydride), poly(ethylene-co-maleic anhydride) and poly(methyl vinyl ether-co-maleic anhydride).

Examples of other layers containing polymers having an activation energy of less than 18 kcal/mole are polyvinyl acetate, cellulose acetate phthalate, partial acetals of polyvinyl alcohol, a polymer latex of butyl acrylate-diacetone acrylamide-styrene-methacrylic acid (60/30/4/6) as described in U.S. Pat. No. 3,785,815, mixtures of polyvinyl acetate and polyvinyl alcohol such as polyvinyl acetate latex in 78/22 ratio with polyvinyl alcohol, cellulose acetate (40 percent acetate in 95/5 ratio with poly[styrene-co-maleic anhydride] [50/50 mole ratio]) as described in U.S. Pat. No. 4,009,030, and the like.

One embodiment of an assemblage of an integral transfer color element and a process for producing a photographic transfer image in color in which my invention can be employed is disclosed in Canadian Pat. No. 928,559. In this embodiment, the support for the photosensitive element is transparent and is coated with an image-receiving layer, a light-reflective layer, an opaque layer and photosensitive layers, having associated therewith dye image-providing material layers. A rupturable container containing the alkaline processing composition described above and an opacifier such as carbon black is positioned adjacent the top layer and a transparent cover sheet. The cover sheet comprises a transparent support which is coated with a neutralizing layer and a timing layer containing the hydroquinone esters according to the invention. The film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the assemblage to protect it from exposure. The processing composition develops each silver halide layer and dye images are formed as a result of development which diffuse to the image-receiving layer to provide a right-reading image which is viewed through the transparent support on the opaque reflecting layer background. The neutralizing layer then neutralizes the alkaline processing composition after the timing layer has been permeated, thus "shutting down" the system. For further details concerning the format of this particular integral assemblage, reference is made to the above-mentioned Canadian Pat. No. 928,559, which is incorporated herein by reference.

Another embodiment of an assemblage of an integral transfer color element and a process for producing a photographic transfer image in color in which my invention can be employed is described in U.S. Pat. No. 3,415,644. In this embodiment, the negative comprises an opaque support which is coated with photosensitive layers having associated therewith dye image-providing material layers. A rupturable container containing the alkaline processing composition described above, $TiO_2$ and an indicator dye (see U.S. Pat. No. 3,647,437) is positioned adjacent the top layer and a transparent receiver. The receiver comprises a transparent support which is coated with a neutralizing layer, a timing layer containing the hydroquinone esters according to the invention and an image-receiving layer. The film unit is placed in a camera, exposed through the transparent receiver and then passed through a pair of pressure-applying members in the camera as it is being removed therefrom. The pressure-applying members rupture the container and spread processing composition, $TiO_2$ and indicator dye over the image-forming portion of the assemblage to protect it from exposure. The processing composition develops each silver halide layer and dye images are formed as a result of development which diffuse to the image-receiving layer which is viewed through the transparent support on a white background—the indicator dye having "shifted" to a colorless form as the alkali is consumed by the neutralizing layer. As before, the neutralizing layer then neutralizes the alkaline processing composition after the timing layer has been permeated, thus "shutting down" the system. For further details concerning the format of this particular assemblage, reference is made to the above-mentioned U.S. Pat. No. 3,415,644, which is incorporated herein by reference. Since the image in this embodiment is geometrically reversed, an image-reversing optical system such as a mirror in the camera is needed to reverse the image so that a right-reading image is viewable in the dye image-receiving layer.

Another embodiment of an assemblage of a color diffusion transfer film unit in which this invention can be employed in a dye image-receiving element is described in U.S. Pat. No. 3,362,819. The image-receiving element comprises a support, which is usually opaque, having thereon a neutralizing layer, a timing layer containing the hydroquinone esters of the invention and a dye image-receiving layer. For further details concerning the use of such an element in color transfer assemblages, reference is made to the above-mentioned U.S. Pat. No. 3,362,819, which is incorporated herein by reference.

Still other useful integral formats in which my invention can be employed are described in U.S. Pat. Nos. 3,415,645; 3,415,646; 3,647,437; 3,635,707; and British Pat. No. 1,330,524.

The photosensitive element useful in my invention can be treated with an alkaline processing composition to effect or initiate development in any manner. A preferred method for applying processing composition is by use of a rupturable container or pod which contains the composition. In general, the processing composition employed in my invention contains the developing agent for development. Where the developer is incorporated in the photosensitive element, the alkaline processing composition serves to activate the incorporated developer.

The dye image-providing materials which may be employed in my invention generally may be characterized as either (1) initially soluble or diffusible in the processing composition but are selectively rendered nondiffusible in an imagewise pattern as a function of development, such as those disclosed, for example, in U.S. Pat. Nos. 2,647,049; 2,661,293; 2,698,244; 2,698,798; 2,802,735; 2,774,668; and 2,983,606; or (2) initially insoluble or nondiffusible in the processing composition but which are selectively rendered diffusible in an imagewise pattern as a function of development, such as those disclosed, for example, in U.S. Pat. Nos. 3,227,550; 3,227,551; 3,227,552; 3,227,554; 3,243,294; and 3,445,228. These materials may be preformed dyes or dye precursors, e.g., color couplers, oxichromic compounds and the like.

In a preferred embodiment of my invention the dye image-providing material is a nondiffusible or ballasted redox dye releaser. Such compounds are, generally speaking, compounds which can be oxidized by oxidized developing agent, i.e., cross-oxidized, to provide a species which as a function of oxidation will release a diffusible dye, such as by alkaline hydrolysis, or prevent the release of dye, such as by intramolecular nucleophilic displacement. Such dye releasers are described in U.S. Pat. Nos. 3,725,062 of Anderson and Lum, issued Apr. 3, 1973; 3,698,897 of Gompf and Lum, issued Oct. 17, 1972; 3,443,939 and 3,443,940 of Bloom et al, issued May 13, 1969; 3,928,312 of Fleckenstein, issued Dec. 23, 1975; 3,929,760 of Landholm et al, issued Dec. 20, 1975; 3,942,987 of Landholm et al, issued Mar. 9, 1976; 3,932,380 of Krutak et al, issued Jan. 13, 1976; 3,980,479 of Fields et al, issued Sept. 14, 1976; 4,076,529 of Fleckenstein et al, issued Feb. 28, 1978; 3,993,638 of Fleckenstein, issued Nov. 23, 1976; 3,954,476 of Krutak et al, issued May 4, 1976; 4,013,633 of Haase et al, issued Mar. 22, 1977; German OLS 2,406,664; U.S. Pat. No. 4,152,153 of Fleckenstein et al, issued May 1, 1979; commonly assigned copending U.S. patent application Ser. Nos. 534,966 of Hinshaw et al, filed Dec. 20, 1974; and 589,973 of Hinshaw et al, filed June 24, 1975; and 775,025 of Chasman et al, issued Feb. 13, 1979; the disclosures of which are hereby incorporated by reference.

In an especially preferred embodiment of my invention, the dye releasers such as those in the Fleckenstein et al patents and applications referred to above are employed. Such compounds are ballasted sulfonamido compounds which are alkali-cleavable upon oxidation to release a diffusible dye from the nucleus and have the formula:

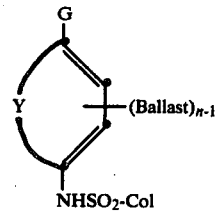

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is $OR_2$ or $NHR_3$ wherein $R_2$ is hydrogen or a hydrolyzable moiety and $R_3$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (when $R_3$ is an alkyl group of greater than 6 carbon atoms, it can serve as a partial or sole Ballast group);

(d) Y represents the atoms necessary to complete a benzene nucleus, a naphthalene nucleus, or a 5- to 7-membered heterocyclic ring such as pyrazolone, pyrimidine, etc; and (e) n is a positive integer of 1 to 2 and is 2 when G is $OR_2$ or when $R_3$ is a hydrogen or an alkyl group of less than 8 carbon atoms.

For further details concering the above-described sulfonamido compounds and specific examples of same, reference is made to the above-mentioned Fleckenstein et al patents and applications referred to above.

In another preferred embodiment of my invention, initially diffusible dye image-providing materials are employed such as dye developers, including metal complexed dye developers such as those described in U.S. Pat. Nos. 3,453,107; 3,544,545; 3,551,406; 3,563,739; 3,597,200; 3,705,184; and oxichromic developers as described and claimed in my coworkers' Lestina and Bush Application Ser. No. 308,869, filed Nov. 22, 1972, now U.S. Pat. No. 3,880,658, the disclosures of which are hereby incorporated by reference. When oxichromic developers are employed, the image is formed by the diffusion of the oxichromic developer to the dye image-receiving layer where it undergoes chromogenic oxidation to form an image dye.

The assemblage of the present invention may be used to produce positive images in single- or multicolors. In a three-color system, each silver halide emulsion layer of the film assembly will have associated therewith a dye image-providing material possessing a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have cyan dye image-providing material associated therewith. The dye image-providing material associated with each silver halide emulsion layer may be contained either in the silver halide emulsion layer itself or in a layer contiguous to the silver halide emulsion layer.

The concentration of the dye image-providing materials that are employed in the present invention may be varied over a wide range depending upon the particular compound employed and the results which are desired. For example, the dye image-providing compounds may be coated in a layer at a concentration of 0.1 to 3 g/m$^2$. The dye image-providing material may be dispersed in a hydrophilic film-forming natural material or synthetic polymer binder, such as gelatin, polyvinyl alcohol, etc., which is adapted to be permeated by aqueous alkaline processing composition.

A variety of silver halide developing agents can be employed in this invention. Specific examples of developers which can be employed in this invention include hydroquinone compounds, such as hydroquinone, 2,5-dichlorohydroquinone, 2-chlorohydroquinone and the like; aminophenol compounds, such as 4-aminophenol, N-methylaminophenol, N,N-dimethylaminophenol, 3-methyl-4-aminophenol, 3,5-dibromoaminophenol and the like; catechol compounds, such as catechol, 4-cyclohexylcatechol, 3-methoxycatechol, 4-(N-octadecylamino)catechol and the like; phenylenediamine compounds, such as N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine and the like. In highly preferred embodiments, the developer is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-bis-(hydroxymethyl)-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone, 5-methyl-3-pyrazolidinone, and the like. A combination of different developers, such as those described in U.S. Pat. No. 3,039,869, can also be employed. Such developing agents can be employed in the liquid processing composition or may be contained, at least in part, in any layer or layers of the photographic element or film unit to be activated by the alkaline processing composition, such as in the silver halide emulsion layers, the dye image-providing material layers, interlayers, image-receiving layer, etc.

In using dye releaser compounds in my invention which produce diffusible dye images as a function of development, either conventional negative-working or direct-positive silver halide emulsions may be employed. If the silver halide emulsion employed is a direct-positive silver halide emulsion, such as an internal-image emulsion designed for use in the internal image reversal process or a fogged, direct-positive emulsion such as a solarizing emulsion, which is developable in unexposed areas, a positive image can be obtained in certain embodiments on the dye image-receiving layer. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds, and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject.

Internal-image silver halide emulsions useful in this invention are described more fully in the November 1976 edition of *Research Disclosure,* pages 76 through 79, the disclosure of which is hereby incorporated by reference.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layer for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

While the alkaline processing composition used in this invention can be applied to the assemblage by the use of rupturable containers as described previously, other means for discharging the composition within the assemblage could also be used, e.g., interjecting the compositions with communicating members similar to hypodermic syringes which are attached either to a camera or camera cartridge.

In a color photographic assemblage according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104; 3,043,692; 3,044,873; 3,061,428; 3,069,263; 3,069,264; 3,121,011 and 3,427,158.

Generally speaking, except where noted otherwise, the silver halide emulsion layers in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

The alkaline solution-permeable, light-reflective layer employed in certain embodiments of photographic assemblages of this invention are described more fully in the November 1976 edition of *Research Disclosure,* page 82, the disclosure of which is hereby incorporated by reference.

The neutralizing layer employed in my invention which becomes operative after permeation of the processing composition through the timing layer will effect a reduction in the pH of the image layers from about 13 or 14 to at least 11 and preferably 5 to 8 within a short time after imbibition. Suitable materials and their functioning are disclosed on pages 22 to 23 of the July 1974 edition of *Research Disclosure* and pages 35 to 37 of the July 1975 edition of *Research Disclosure,* the disclosures of which are hereby incorporated by reference.

The inert timing or spacer layer employed in my invention over the neutralizing layer "times" or controls the pH reduction as a function of the rate at which alkali diffuses throughout the inert spacer layer. Examples of such timing layers and their functioning are disclosed in the *Research Disclosure* articles mentioned in the paragraph above concerning neutralizing layers.

Any material can be employed as the image-receiving layer in this invention as long as the desired function of mordanting or otherwise fixing the dye images will be obtained. The particular material chosen will, of course, depend upon the dye to be mordanted. Suitable materials are disclosed on pages 80 to 82 of the November 1976 edition of *Research Disclosure,* the disclosure of which is hereby incorporated by reference.

The alkaline processing composition employed in this invention is the conventional aqueous solution of an alkaline material, e.g., alkali metal hydroxides or carbonates such as sodium hydroxide, sodium carbonate, or an amine such as diethylamine, possessing a pH of at least about 11, and preferably containing a developing agent as described previously. Suitable materials and addenda frequently added to such compositions are disclosed on pages 79 to 80 of the November 1976 edition of *Research Disclosure,* the disclosure of which is hereby incorporated by reference.

The supports for the photographic elements of this invention can be any material as long as it does not deleteriously effect the photographic properties of the film unit and is dimensionally stable. Typical flexible sheet materials are described on page 85 of the November 1976 edition of *Research Disclosure,* the disclosure of which is hereby incorporated by reference.

The silver halide emulsions useful in this invention, both negative-working and direct-positive ones, are well known to those skilled in the art and are described in *Product Licensing Index,* Volume 92, December 1971, publication 9232, paragraph I, "Emulsion types"; they may be chemically and spectrally sensitized as described on page 107, paragraph III, "Chemical sensitization", and pages 108 and 109, paragraph XV, "Spectral sensitization", of the above article; they can be protected against the production of fog and can be stabilized against loss of sensitivity during keeping by employing the materials described on page 107, paragraph V, "Antifoggants and stabilizers", of the above article; they can contain development modifiers, hardeners, and coating aids as described on pages 107 through 108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on page 108, paragraph XI, "Plasticizers and lubricants", and paragraph VIII, "Vehicles", and page 109, paragraph XVI, "Absorbing and filter dyes", of the above article; they and other layers in the photographic elements used in this invention may contain addenda which are incorporated by using the procedures described on page 109, paragraph XVII, "Methods of addition", of the above article; and they can be coated by using the various techniques described on page 109, paragraph XVIII, "Coating procedures", of the above article, the disclosures of which are hereby incorporated by reference.

The term "nondiffusing" used herein has the meaning commonly applied to the term in photography and denotes materials that for all practical purposes do not migrate nor wander through organic colloid layers of the photographic elements of the invention in an alkaline medium, preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium in the presence of "nondiffusing" materials. "Mobile" has the same meaning.

The term "associated therewith" as used herein is intended to mean that the materials can be in either the same or different layers so long as the materials are accessible to one another.

The following examples further illustrate the invention.

EXAMPLE 1

(A) A control cover sheet was prepared by coating the following layers in the order received on a 0.004-inch poly(ethylene terephthalate) film base:

(1) An acid layer comprising 15.5 g/m$^2$ of poly(n-butyl acrylate-co-acrylic acid (30 percent acrylic acid) and 0.43 g/m$^2$ of Dicalite (trademark), Grade 103 diatomaceous earth;

(2) A timing layer comprising 1.929 g/m$^2$ of cellulose acetate (40 percent acetyl) and 0.24 g/m$^2$ of poly(styrene-co-maleic anhydride); and (3) A second timing layer of 2.15 g/m$^2$ of poly(acrylonitrile-co-vinylidene chloride-co-acrylic acid) (15:79:6).

(B) Another cover sheet was prepared similar to (A), except that layer 2 contained 0.22 g/m$^2$ of hydroquinone monoacetate.

An integral photographic element of the type described in Element 10 of U.S. Pat. No. 4,030,925 of Leone et al, issued June 21, 1977, was exposed to a tungsten light source through a graduated density multicolor test object.

The following processing composition was employed in a pod and spread between the exposed photosensitive element and the transparent cover sheets described above at 16° C. and 38° C. by passing the transfer "sandwich" between a pair of juxtaposed rollers so that the liquid layer was about 0.003 inch.

| | | |
|---|---|---|
| Distilled water | 850 | ml |
| Potassium hydroxide | 46.8 | g |
| Sodium sulfite (anhydrous) | 1.0 | g |
| 5-methyl-1,2,3-benzotriazole | 3.8 | g |
| 4-hydroxymethyl-4-methyl-1-phenyl-3-pyrazolidone | 12.0 | g |
| t-butylhydroquinone | 0.3 | g |
| Carboxymethyl cellulose | 56.6 | g |
| Tamol SN (Trademark of Rohm and Haas Company) dispersing agent | 8.8 | g |
| Carbon | 171.0 | g |
| Potassium fluoride | 10.0 | g |
| Methyl hydroquinone | 0.1 | g |
| 1,4-cyclohexanedimethanol | 1.0 | g |
| Sodium hydroxide | 3.4 | g |
| 4-chloro-3,5-xylenol | 0.04 | g |

The sensitometric changes observed upon processing these elements at 16° C. and 38° C. were as follows:

TABLE I

| | $\Delta D_{min}$ | | | $\Delta D_{max}$ | | | $\Delta$ Log E* | | |
|---|---|---|---|---|---|---|---|---|---|
| Element | Blue | Green | Red | Blue | Green | Red | Blue | Green | Red |
| A (control) | +0.02 | +0.04 | +0.05 | −0.13 | −0.02 | +0.31 | −0.04 | −0.16 | −0.44 |
| B | 0.00 | +0.01 | +0.03 | −0.36 | −0.05 | +0.27 | +0.18 | +0.12 | −0.07 |

*Speed measured at 0.70 density-differential between processing at 16° C. and 38° C.

The above results indicate that the speed loss has been significantly reduced in Element B, especially in the figures given for the red region.

EXAMPLE 2

Comparative Test (A) A control cover sheet was prepared by coating the following layers in the order recited on a 0.004-inch poly(ethylene terephthalate) film support:

(1) a polyacrylic acid layer (17.5 meq/0.093 m²)

(2) a timing layer comprising a polymeric mixture as disclosed in an application by my coworker Abel, entitled "Barrier Layer Between Reactants in Photographic Products Comprising a Mixture of Vinylidene Chloride Terpolymer and Polymeric Carboxy-Ester-Lactone", U.S. application Ser. No. 948,062, filed Oct. 2, 1978.

(B) A cover sheet similar to (A) above was prepared, except that layer 2 contained Compound 3 above at 0.26 mmole/m².

(C) A cover sheet similar to (A) above was prepared, except that layer 2 contained Compound 3 above at 0.52 mmole/m².

(D) A comparative control cover sheet similar to (A) above was prepared, except that layer 2 contained the following oxazine compound, structurally similar to Compound 3 above, at 0.26 mmole/m²:

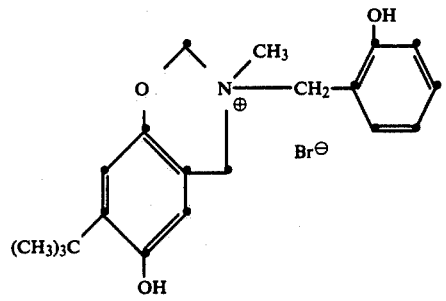

(E) A comparative control cover sheet similar to (D) above was prepared, except that the oxazine compound was coated at 0.52 mmole/m².

An integral imaging receiving element was prepared by coating the following layers in the order recited on a transparent poly(ethylene terephthalate) film support. Quantities are parenthetically given in g/m², unless otherwise stated.

(1) image-receiving layer of a poly(divinylbenzene-co-styrene-co-N-benzyl-N,N-dimethyl-N-vinylbenzyl-)ammonium sulfate latex mordant (2.3) and gelatin (2.3);

(2) reflecting layer of titanium dioxide (16) and gelatin (2.6);

(3) opaque layer of carbon black (1.9) and gelatin (1.2);

(4) cyan dye-providing layer of gelatin (1.2), cyan RDR A (0.3), dispersed in 1,4-cyclohexylenedimethylene bis(2-ethylhexanoate) and gelatin (0.7);

(5) red-sensitive, direct-positive silver bromide emulsion (silver-0.9, gelatin-0.9), 1-[4-(2-formylhydrazino)-phenyl]-3-methylthiourea (0.01), 2-(2-octadecyl-5-sulfohydroquinone potassium salt (0.2), and aceto-2-{p-[5-amino-2-(2,4-di-t-pentylphenoxy)benzamido]phenyl}-hydrazide (0.1);

(6) interlayer of gelatin (1.6) and 2,5-di-sec-dodecylhydroquinone (1.3);

(7) magenta dye-providing layer of magenta RDR B (0.3) dispersed in 1,4-cyclohexylenedimethylene-bis(2-ethylhexanoate) and gelatin (0.7);

(8) green-sensitive, direct-positive silver bromide emulsion (silver-0.9, gelatin-0.9), 1-[4-(2-formylhydrazino)phenyl]-3-methylthiourea (0.01), aceto-2-{p-[5-amino-2-(2,4-di-t-pentylphenoxy)benzamido]phenyl}-hydrazide (0.4), and 2-(2-octadecyl-5-sulfohydroquinone potassium salt (0.2);

(9) interlayer of gelatin (1.6) and 2,5-di-sec-dodecylhydroquinone (1.3);

(10) yellow dye-providing layer of yellow RDR C (0.4) dispersed in 1,4-cyclohexylenedimethylene-bis(2-ethylhexanoate) and gelatin (0.7);

(11) blue-sensitive, direct-positive silver bromide emulsion (silver-0.9, gelatin-0.9), 1-[4-(2-formylhydrazino)phenyl]-3-methylthiourea (0.005), aceto-2-{p-[5-amino-2-(2,4-di-t-pentylphenoxy)benzamido]- phenyl}hydrazide (0.2), and 2-(2-octadecyl-5-sulfohydroquinone potassium salt (0.2); and

(12) overcoat layer of gelatin (0.9).

CYAN RDR A

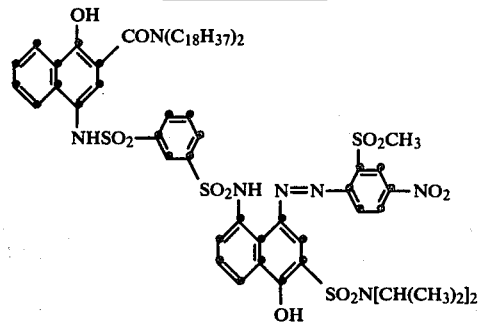

MAGENTA RDR B

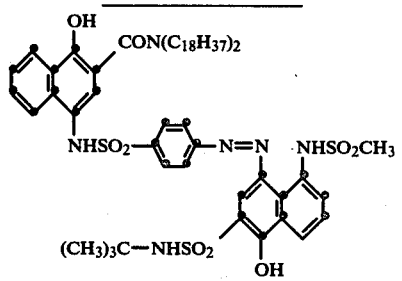

YELLOW RDR C

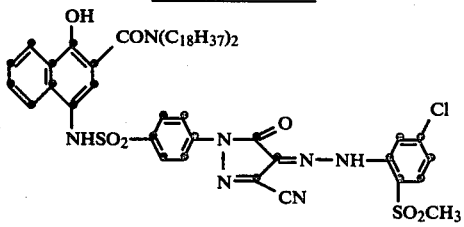

Samples of the above-prepared photosensitive elements were exposed through a multicolor graduated-density test object. The exposed samples were then processed by rupturing a pod containing the viscous processing composition described below between the photosensitive element and the cover sheets described above.

| | |
|---|---|
| Potassium hydroxide | 47.0 g |
| Sodium sulfite (anhydrous) | 1.0 g |
| 5-methyl-1,2,3-benzotriazole | 5.0 g |
| 4-hydroxymethyl-4-methyl-1-p-tolyl-3-pyrazolidinone | 8.5 g |
| t-butylhydroquinone | 0.2 g |
| Carboxymethylcellulose | 43.6 g |
| Tamol SN (trademark of Rohm and Haas Company) dispersing agent | 6.4 g |
| Carbon | 171.0 g |
| Potassium fluoride | 6.0 g |
| 1,4-cyclohexanedimethanol | 2.5 ml |
| Sodium hydroxide | 3.4 g |
| Distilled water to 1 liter | |

Samples of the above-described cover sheets were evaluated for processing temperature latitude by processing under two temperature conditions: (1) at 16° C., and (2) heating the complete assemblage to 30° C., processing for 15 seconds, and then heating the assemblage to 50° C. for 4 minutes to complete the process. The following sensitometric results were obtained:

TABLE II

| Cover Sheet | Competing Developer | Concentration (mmoles/m²) | Log E* (16° C.) Red | Log E* (16° C.) Green | Log E* (16° C.) Blue | Log E* (30–50° C.) Red | Log E* (30–50° C.) Green | Log E* (30–50° C.) Blue | ΔLog E* Red | ΔLog E* Green | ΔLog E* Blue |
|---|---|---|---|---|---|---|---|---|---|---|---|
| A (control) | None | — | 0.11 | −0.10 | −0.23 | −0.14 | −0.37 | −0.57 | −0.25 | −0.27 | −0.24 |
| B | Compound 3 | 0.26 | 0.12 | −0.07 | −0.22 | −0.09 | −0.31 | −0.46 | −0.21 | −0.24 | −0.24 |
| C | Compound 3 | 0.52 | 0.10 | −0.10 | −0.19 | −0.09 | −0.29 | −0.42 | −0.19 | −0.19 | −0.23 |
| D (comparative control) | oxazine | 0.26 | 0.16 | −0.07 | −0.21 | −0.12 | −0.34 | −0.50 | −0.28 | −0.27 | −0.29 |
| E (comparative control) | oxazine | 0.52 | 0.14 | −0.06 | −0.21 | −0.18 | −0.41 | −0.56 | −0.32 | −0.35 | −0.35 |

*Speed measured at 0.70 density

The above results indicate that use of cover sheets B and C in accordance with the invention improved the processing temperature latitude, especially in the red- and green-sensitive layers. Use of cover sheets D and E, however, which contained the oxazine compound, caused a loss in processing temperature latitude (worse than control A with no competer).

The invention has been described in detail with particular reference to preferred embodiments thereof, but it will be understood that variations and modifications can be effected within the spirit and scope of the invention.

What is claimed is:

1. In a photographic assemblage comprising:

(a) a support having thereon at least one photosensitive silver halide emulsion layer having associated therewith a dye image-providing material;

(b) a dye image-receiving layer;

(c) an alkaline processing composition and means for discharging same within said assemblage;

(d) a neutralizing layer for neutralizing said alkaline processing composition; and (e) a timing layer disposed between said neutralizing layer and said photosensitive silver halide emulsion layer so that said processing composition must first permeate said timing layer before contacting said neutralizing layer;

said neutralizing layer being located on the side of said timing layer which is farthest from said dye image-receiving layer, said assemblage containing a silver halide developing agent, the improvement wherein said assemblage contains a hydroquinone ester either in said timing layer or in a layer which is adjacent thereto, said adjacent layer being so located with respect to said timing layer that said processing composition must first permeate said timing layer before contacting said adjacent layer, said hydroquinone ester having the following formula:

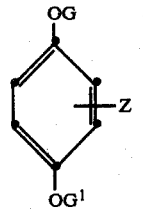

wherein:

G is hydrogen, COR or $SO_2R$;

$G^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

and wherein said timing layer has an activation energy of penetration of the layer by an aqueous alkaline solution of greater than 18 kcal/mole.

2. The assemblage of claim 1 wherein:

(a) said dye image-receiving layer is located between said support and said silver halide emulsion layer; and (b) said assemblage also includes a transparent cover sheet over the layer outermost from said support.

3. The assemblage of claim 2 wherein said transparent cover sheet is coated with said neutralizing layer and said timing layer, respectively.

4. The assemblage of claim 2 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

5. The assemblage of claim 1 wherein said hydroquinone ester is hydroquinone diacetate, hydroquinone monoacetate, hydroquinone monohexanoate, 3-t-butyl-4-hydroxyphenyl acetate, hydroquinone monobenzoate, 2-methylhydroquinone monoacetate, 2-methoxyhydroquinone monoacetate, 2-methylhydroquinone monobenzoate, 2-methoxyhydroquinone monobenzoate, 2-ethoxyhydroquinone monoacetate, 2-ethoxyhydroquinone monobenzoate, p-methylsulfonyloxyphenol, and p-tolylsulfonyloxyphenol.

6. The assemblage of claim 1 wherein said hydroquinone ester is present at a concentration of from about 0.054 $g/m^2$ to about 0.54 $g/m^2$.

7. The assemblage of claim 1 wherein said timing layer comprises a polymeric latex comprising a polymer of from about 5 to about 35 percent by weight of polymerized ethylenically unsaturated monomer, from about 2 to about 10 percent by weight of polymerized ethylenically unsaturated carboxylic acid, and from about 55 to about 85 percent by weight of polymerized vinylidene chloride.

8. The assemblage of claim 1 wherein said timing layer comprises a polymeric latex comprising from about 5 to about 35 percent by weight of acrylonitrile, from about 2 to about 10 percent by weight of a member selected from the group consisting of acrylic acid and itaconic acid and from about 55 to about 85 percent by weight of vinylidene chloride.

9. The assemblage of claim 1 wherein said timing layer comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxy-ester-lactone.

10. The assemblage of claim 1 wherein said hydroquinone ester is in a layer adjacent to said timing layer, said adjacent layer comprising a polymeric latex having an activation energy of penetration of the layer by an aqueous alkaline solution of less than 18 kcal/mole.

11. The assemblage of claim 10 wherein said adjacent layer comprises a mixture of cellulose acetate and a maleic anhydride copolymer, said mixture comprising about 5 to about 50 percent by weight of said copolymer.

12. The assemblage of claim 1 wherein said dye image-providing material is a ballasted sulfonamido compound which is alkali-cleavable upon oxidation to release a diffusible color-providing moiety from a benzene nucleus, said compound having the formula:

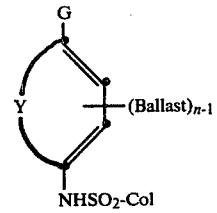

wherein:

(a) Col is a dye or dye precursor moiety;

(b) Ballast is an organic ballasting radical of such molecular size and configuration as to render said compound nondiffusible in said photosensitive element during development in an alkaline processing composition;

(c) G is $OR_2$ or $NHR_3$ wherein $R_2$ is hydrogen or a hydrolyzable moiety and $R_3$ is hydrogen or an alkyl group of 1 to 22 carbon atoms;

(d) Y represents the atoms necessary to complete a benzene nucleus, a naphthalene nucleus, or a 5- to 7-membered heterocyclic ring; and (e) n is a positive integer of 1 to 2 and is 2 when G is $OR_2$ or when $R_3$ is hydrogen or an alkyl group of less than 8 carbon atoms.

13. An integral photographic assemblage comprising:

(a) a photosensitive element comprising a transparent support having thereon the following layers in sequence: a dye image-receiving layer; an alkaline solution-permeable, light-reflective layer; an alkaline solution-permeable, opaque layer; a red-sensitive, direct positive silver halide emulsion layer having a ballasted redox cyan dye releaser associated therewith; a green-sensitive, direct positive silver halide emulsion layer having a ballasted redox magenta dye releaser associated therewith; and a blue-sensitive, direct positive silver halide emulsion layer having a ballasted redox yellow dye releaser associated therewith;

(b) a transparent sheet superposed over said blue-sensitive silver halide emulsion layer and comprising a transparent support coated with, in sequence, a neutralizing layer and a timing layer; and (c) a rupturable container containing an alkaline processing composition and an opacifying agent, said container being so positioned during processing of said assemblage that a compressive force applied to said container will effect a discharge of the container's contents between said transparent sheet and said blue-sensitive silver halide emulsion layer;

said assemblage containing a silver halide developing agent, the improvement wherein said assemblage contains a hydroquinone ester either in said timing layer or in a layer which is adjacent thereto, said adjacent layer being so located with respect to said timing layer that said processing composition must first permeate said timing layer before contacting said adjacent layer, said hydroquinone ester having the following formula:

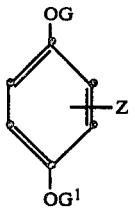

wherein:

G is hydrogen, COR or $SO_2R$;

$G^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

and wherein said timing layer has an activation energy of penetration of the layer by an aqueous alkaline solution of greater than 18 kcal/mole.

14. The assemblage of claim 13 wherein each said redox dye releaser is a ballasted sulfonamido compound which is alkali-cleavable upon oxidation to release a diffusible color-providing moiety from a benzene nucleus, said compound having the formula:

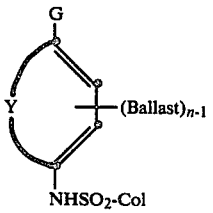

wherein:

(a) Col is a dye or dye precursor moiety;

(b) Ballast is an organic ballasting radical of such molecular size and configuration as to render said compound nondiffusible in said photosensitive element during development in an alkaline processing composition;

(c) G is $OR_2$ or $NHR_3$ wherein $R_2$ is hydrogen or a hydrolyzable moiety and $R_3$ is hydrogen or an alkyl group of 1 to 22 carbon atoms;

(d) Y represents the atoms necessary to complete a benzene nucleus, a naphthalene nucleus, or a 5- to 7-membered heterocyclic ring; and (e) n is a positive integer of 1 to 2 and is 2 when G is $OR_2$ or when $R_3$ is hydrogen or an alkyl group of less than 8 carbon atoms.

15. The assemblage of claim 14 wherein each said silver halide emulsion is an internal-image silver halide emulsion, and said timing layer comprises a polymeric latex comprising a polymer of from about 5 to about 35 percent by weight of polymerized ethylenically unsaturated monomer, from about 2 to about 10 percent by weight of polymerized ethylenically unsaturated carboxylic acid, and from about 55 to about 85 percent by weight of polymerized vinylidene chloride.

16. The assemblage of claim 14 wherein each said silver halide emulsion is an internal-image silver halide emulsion; said timing layer comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxy-ester-lactone; and said hydroquinone ester is located in said timing layer.

17. In a process for producing a photographic transfer image in color from an imagewise-exposed photosensitive element comprising a support having thereon at least one photosensitive silver halide emulsion layer having associated therewith a dye image-providing material, said process comprising treating said element with an alkaline processing composition in the presence of a silver halide developing agent to effect development of each of said exposed silver halide emulsion layer, said processing composition contacting said emulsion layer prior to contacting a neutralizing layer; whereby an imagewise distribution of dye image-providing material is formed as a function of development and at least a portion of it diffuses to a dye image-receiving layer to provide said transfer image, whereby a timing layer associated with said neutralizing layer is permeated by said alkaline processing composition after a predetermined time, said timing layer being disposed between said neutralizing layer and said photosensitive silver halide emulsion layer so that said processing composition must first permeate said timing layer before contacting said neutralizing layer, said neutralizing layer being located on the side of said timing layer which is farthest from said dye image-receiving layer; whereby said alkaline processing composition is neutralized by means of said neutralizing layer associated with said photographic element after said predetermined time; the improvement wherein a hydroquinone ester is employed either in said timing layer or in a layer adjacent thereto, said adjacent layer being so located with respect to said timing layer that said processing composition must first permeate said timing layer before contacting said adjacent layer, said hydroquinone ester having the following formula:

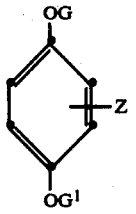

wherein:

G is hydrogen, COR or $SO_2R$;

$G^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

and wherein said timing layer has an activation energy of penetration of the layer by an aqueous alkaline solution of greater than 18 kcal/mole.

18. The process of claim 17 wherein said hydroquinone ester is hydroquinone diacetate, hydroquinone monoacetate, acetate, hydroquinone monohexanoate, 3-t-butyl-4-hydroxyphenyl acetate, hydroquinone monobenzoate, 2-methylhydroquinone monoacetate, 2-methoxyhydroquinone monoacetate, 2-methylhydroquinone monobenzoate, 2-methoxyhydroquinone monobenzoate, 2-ethoxyhydroquinone monoacetate, 2-ethoxyhydroquinone monobenzoate, p-methylsulfonyloxyphenol, and p-tolylsulfonyloxyphenol.

19. The process of claim 17 wherein said hydroquinone ester is present at a concentration of from about 0.054 $g/m^2$ to about 0.54 $g/m^2$.

20. The process of claim 17 wherein said timing layer comprises a polymeric latex comprising a polymer of from about 5 to about 35 percent by weight of polymerized ethylenically unsaturated monomer, from about 2 to about 10 percent by weight of polymerized ethylenically unsaturated carboxylic acid, and from about 55 to about 85 percent by weight of polymerized vinylidene chloride.

21. The process of claim 17 wherein said timing layer comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from about 5 to about 95 percent by weight of a polymeric carboxy-ester-lactone.

22. In a dye image-receiving element comprising a support having thereon, in sequence, a neutralizing layer, a timing layer and a dye image-receiving layer, the improvement wherein a hydroquinone ester is employed in a layer between said dye image-receiving layer and said support, said hydroquinone ester having the following formula:

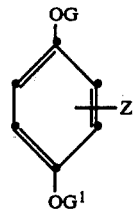

wherein:

G is hydrogen, COR or $SO_2R$;

$G^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

and wherein said timing layer has an activation energy of penetration of the layer by an aqueous alkaline solution of greater than 18 kcal/mole.

23. In a cover sheet comprising a transparent support having thereon, in sequence, a neutralizing layer and a timing layer, the improvement wherein said cover sheet contains a hydroquinone ester having the following formula:

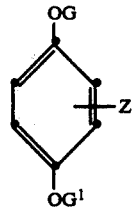

wherein:

G is hydrogen, COR or $SO_2R$;

$G^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

and wherein said timing layer has an activation energy of penetration of the layer by an aqueous alkaline solution of greater than 18 kcal/mole.

24. The cover sheet of claim 23 wherein said timing layer comprises a polymeric latex comprising a polymer of from about 5 to about 35 percent by weight of polymerized ethylenically unsaturated monomer, from about 2 to about 10 percent by weight of polymerized ethylenically unsaturated carboxylic acid, and from about 55 to about 85 percent by weight of polymerized vinylidene chloride.

25. The cover sheet of claim 23 wherein said timing layer comprises a mixture of (1) from about 5 to about 95 percent by weight of a terpolymer comprising from about 55 to about 85 percent by weight of vinylidene chloride, from about 5 to about 35 percent by weight of an ethylenically unsaturated monomer, and from about 0 to about 20 percent by weight of an ethylenically unsaturated carboxylic acid, and (2) from aout 5 to about 95 percent by weight of a polymeric carboxy-ester-lactone.

* * * * *